US012429245B2

(12) United States Patent
Thompson et al.

(10) Patent No.: US 12,429,245 B2
(45) Date of Patent: Sep. 30, 2025

(54) DAMPER FOR HVAC SYSTEM

(71) Applicant: Air Distribution Technologies IP, LLC, Milwaukee, WI (US)

(72) Inventors: Cody Christopher Thompson, Overland Park, KS (US); Edward Neal Koop, Grandview, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 441 days.

(21) Appl. No.: 17/170,530

(22) Filed: Feb. 8, 2021

(65) Prior Publication Data

US 2022/0252298 A1 Aug. 11, 2022

(51) Int. Cl.
*F24F 13/15* (2006.01)
*F24F 13/14* (2006.01)

(52) U.S. Cl.
CPC ..... *F24F 13/15* (2013.01); *F24F 13/1406* (2013.01); *F24F 13/1426* (2013.01)

(58) Field of Classification Search
CPC .... F24F 13/15; F24F 13/1406; F24F 13/1426; F24F 13/14; F24F 13/32; F24F 13/20; F24F 2221/52; F24F 2013/088; F24F 13/084; E04C 2/521; E04C 2/523; E04C 1/392; E04C 1/523; E06B 7/086; E06B 7/084; E06B 7/082; E06B 7/098
See application file for complete search history.

(56) References Cited

U.S. PATENT DOCUMENTS 2,802,410 A * 8/1957 Robinson ..... F24F 13/08 454/283
3,350,996 A * 11/1967 Rose ..... E06B 7/084 454/258
3,653,317 A * 4/1972 Costanzo, Jr. ..... F24F 13/15 454/319
3,783,768 A * 1/1974 Caming ..... F24F 13/15 454/335
4,114,646 A 9/1978 McCabe
4,541,328 A * 9/1985 Brzezinski ..... F24F 13/15 137/601.11
6,263,632 B1 * 7/2001 Cadorette ..... E06B 7/086 52/800.12

(Continued)

FOREIGN PATENT DOCUMENTS

GB 744732 A * 2/1956
GB 2185307 B 11/1989

OTHER PUBLICATIONS

Sanka Silva, Duct Sizing Methods and Filter Types, Jul. 10, 2018, pp. 1-72, https://www.slideshare.net/SANKA_SILVA/duct-sizing-methods-and-filter-types.

*Primary Examiner* — Jessica Yuen
(74) *Attorney, Agent, or Firm* — Michael Best & Friedrich LLP

(57) ABSTRACT

A damper for a heating, ventilation, and air conditioning (HVAC) system includes a damper blade, a frame coupled to the damper blade and defining a perimeter of an air flow path through the damper, and a frame member of the frame. The frame member defines a portion of the perimeter of the air flow path and includes a base portion, an upstream end portion, and a downstream end portion. Each of the upstream end portion and the downstream end portion extends obliquely from the base portion.

19 Claims, 8 Drawing Sheets

(56) References Cited

U.S. PATENT DOCUMENTS

| | | | | |
|---|---|---|---|---|
| 6,311,445 | B1 * | 11/2001 | Macander | E06B 7/082<br>52/656.9 |
| 2016/0116184 | A1 * | 4/2016 | Chappell | F24F 13/1406<br>454/335 |

* cited by examiner

DAMPER FOR HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include ductwork through which air is directed, such as to and/or from a space serviced by the HVAC system. In some embodiments, a damper may be positioned within the ductwork to enable or block air flow through a portion of the ductwork. Unfortunately, existing geometries and/or configurations of dampers may affect the flow of air through the damper, such as by increasing a pressure drop of the air through the ductwork and reducing efficiency of the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a damper for a heating, ventilation, and air conditioning (HVAC) system includes a damper blade, a frame coupled to the damper blade and defining a perimeter of an air flow path through the damper, and a frame member of the frame. The frame member defines a portion of the perimeter of the air flow path and includes a base portion, an upstream end portion, and a downstream end portion. Each of the upstream end portion and the downstream end portion extends obliquely from the base portion.

In one embodiment, a damper frame of a damper for a heating, ventilation, and air conditioning (HVAC) system includes a frame member defining a portion of a perimeter of an air flow path through the damper. The frame member includes a base portion, an upstream end portion extending obliquely from the base portion, and a downstream end portion extending obliquely from the base portion.

In one embodiment, a damper for a heating, ventilation, and air conditioning (HVAC) system includes a frame defining a perimeter of an air flow path through damper. The frame has a first frame member defining a portion of the perimeter of the air flow path and comprising a first base portion, a first upstream end portion, and a first downstream end portion, in which the first upstream end portion, the first downstream end portion, or both, extend obliquely from the first base portion. The frame also has a second frame member coupled to the first frame member and defining an additional portion of the perimeter of the air flow path, in which the second frame member comprises a second base portion, a second upstream end portion, and a second downstream end portion, and each of the second upstream end portion and the second downstream end portion extends from the second base portion.

DRAWINGS

Various aspects of this disclosure may be better understood upon reading the following detailed description and upon reference to the drawings in which.

Figure 16:
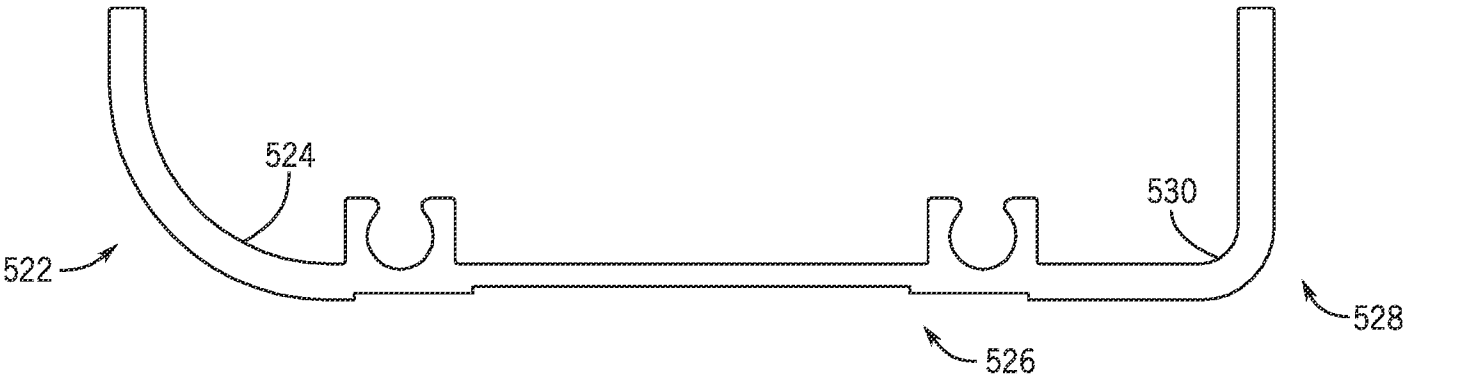
Figure 17:
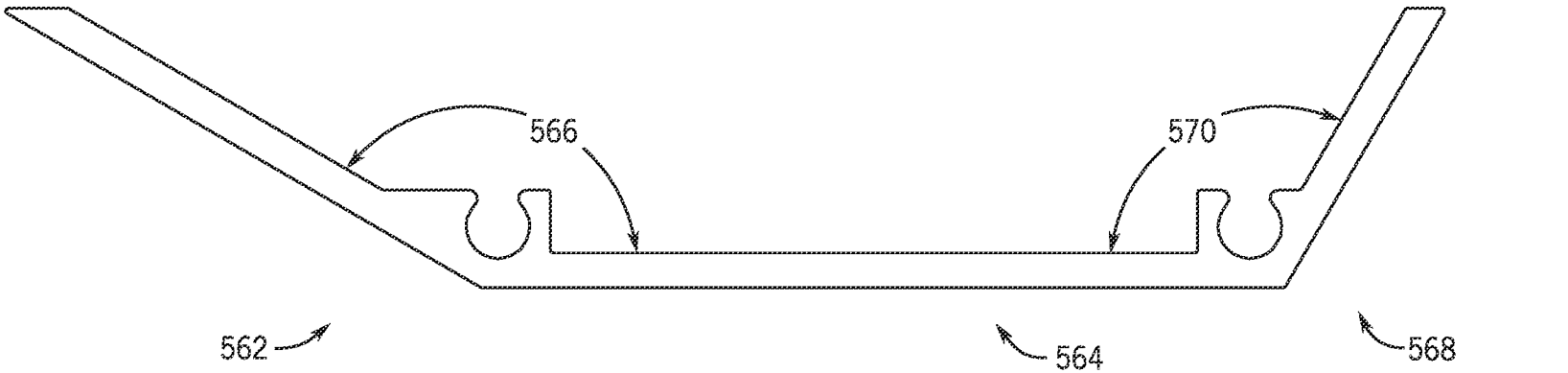

FIG. 16 is an axial view of an embodiment of a frame member of a damper frame, illustrating end portions of the frame member that are asymmetric about a base portion of the frame member, in accordance with an aspect of the present disclosure; and FIG. 17 is an axial view of an embodiment of a frame member of a damper frame, illustrating end portions of the frame member that are asymmetric about a base portion of the frame member, in accordance with an aspect of the present disclosure.

DETAILED DESCRIPTION

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a damper or damper assembly of a heating, ventilation, and/or air conditioning (HVAC) system. The damper may be positioned within ductwork of the HVAC system to control air flowing through a portion of the ductwork. For example, the damper may be configured to control a flow of air from a space into the HVAC system to enable conditioning of the air via the HVAC system. Additionally or alternatively, the damper may be configured to control flow of the air (e.g., conditioned air) out of the HVAC system, such as toward or into the space to condition the space. The damper may include a damper frame defining a perimeter of an air flow path through the HVAC system (e.g., through the ductwork). For example, the damper frame may include an opening through which air is directed, and the damper may include one or more damper blades coupled to the damper frame and extending across the opening. In some embodiments, the damper blades may be configured to transition between an open position and a closed position. In the open position, the damper blades may expose the opening, thereby enabling the damper frame to direct air therethrough. In the closed position, the damper blades may cover the opening, thereby blocking air from being directed through the damper frame.

Unfortunately, geometries or features of existing damper frames may affect a flow of air through the damper. By way of example, the damper frame may have a geometry that affects the flow of air by inducing a flow discontinuity or otherwise interrupting the air flow. For instance, it may be desirable to enable laminar flow of the air through the damper, but the damper frame may induce turbulent flow of the air. The turbulent flow of air may increase a pressure drop and/or a velocity drop of the air directed through the damper. As a result, the damper frame may reduce an efficiency associated with operation of the damper and/or operation of an HVAC system having the damper. For example, an air mover, such as a fan or blower, may operate at a higher power level in order to direct the air through the damper at a target flow rate or speed. As such, there may be an increased cost associated with operation of the HVAC system.

Thus, it is presently recognized that reducing the pressure drop and/or the velocity drop of air directed through the damper may enable more efficient flow of the air through the damper and may therefore reduce costs associated with operation of the HVAC system. Accordingly, embodiments of the present disclosure are directed to a damper frame having a geometry that limits an impact of the damper frame on air flow directed through the damper. For example, the damper frame may have multiple frame members that are arranged to define an opening through which the air may flow through the damper. Each of the frame members may include a base portion, as well as an upstream end portion and a downstream end portion extending (e.g., obliquely) from the base portion. In some embodiments, an end portion may extend linearly from the base portion. In additional or alternative embodiments, an end portion may have an arcuate segment that extends from the base portion. In any case, the orientation of one or both of the end portions relative to the base portion may reduce generation of flow discontinuities in the air or otherwise may reduce an impact of the damper frame on the air flowing through the damper. For example, one or more of the frame members may have a geometry configured to more efficiently guide the air through the opening of the damper frame. Although the present disclosure primarily discusses embodiments of the damper as positioned within ductwork of the HVAC system, additional or alternative embodiments of the damper may be positioned at any other suitable location of the HVAC system, such as part of a housing or an enclosure of the HVAC system (e.g., a rooftop unit, an air handler, etc.).

Figure 1:
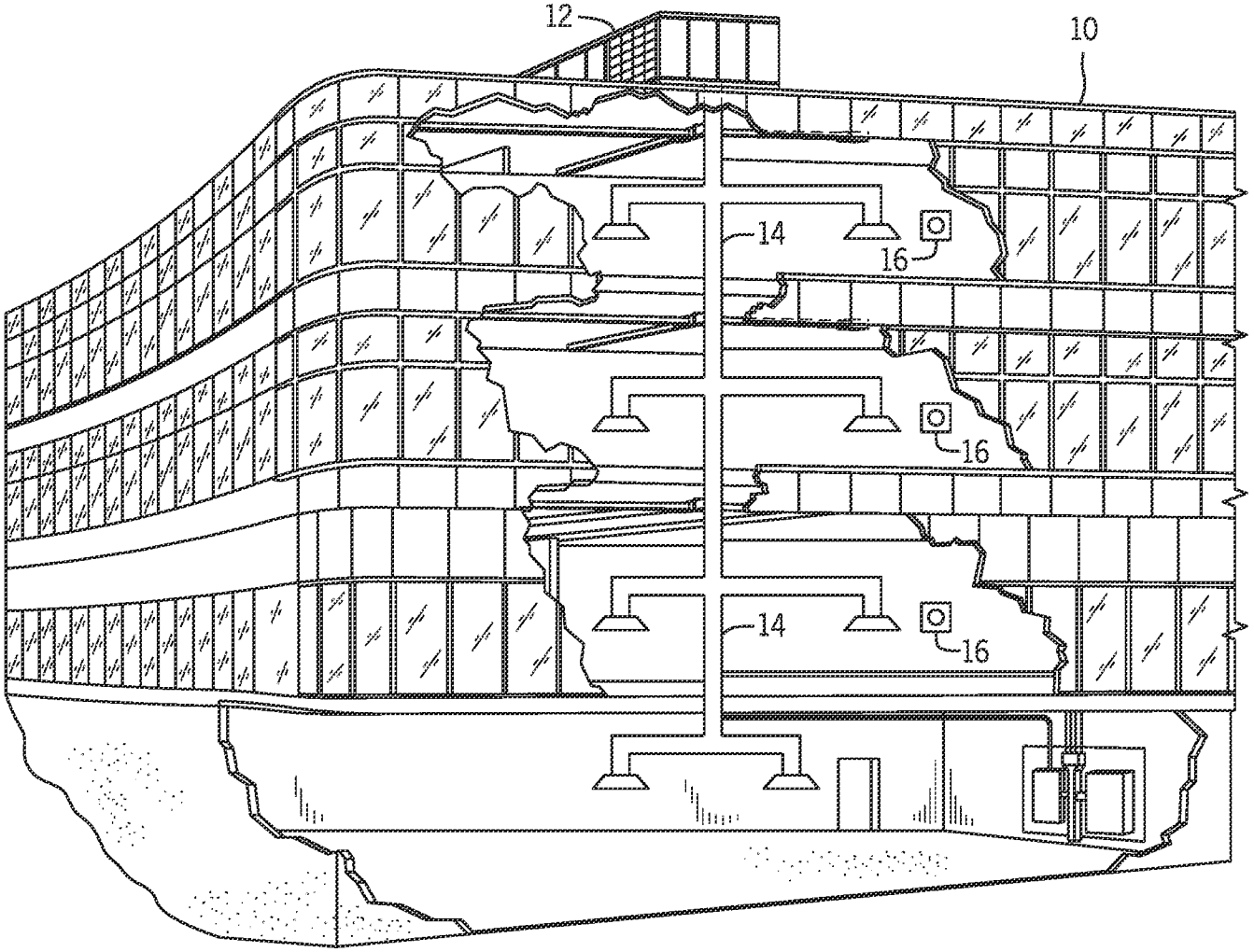
FIG. 1 is a perspective view of an embodiment of a heating, ventilation, and/or air conditioning (HVAC) system for environmental management that may employ one or more HVAC units, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 in the illustrated embodiment is an air cooled device that implements a refrigeration or vapor compression cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building 10 with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

As mentioned above, the present disclosure is directed to a frame of a damper. The frame (e.g., a damper frame) has one or more geometries configured to limit an impact on a flow of air through the damper. For example, the frame may have multiple frame members, each frame member having an upstream end portion and a downstream end portion extending obliquely from a base portion of the frame member. In certain embodiments, an end portion may extend linearly from the base portion. In additional or alternative embodiments, an end portion may include an arcuate segment that extends from the base portion. In any case, the relative orientations of the end portion and the base portion may more efficiently guide the air through the damper, as compared to existing damper designs. For instance, the orientation of the upstream end portion may guide the flow of air into the damper, and the orientation of the downstream end portion may guide the flow of air out of the damper. As a result, the frame may reduce flow discontinuities generated in the air, formation of turbulent air flow, and/or other impact on the flow of the air to enable a reduction in the pressure drop and/or velocity drop of the air flowing through the damper. In this manner, the frame may increase an efficiency associated with operation of the damper and/or an HVAC system incorporating the damper.

Figure 2:
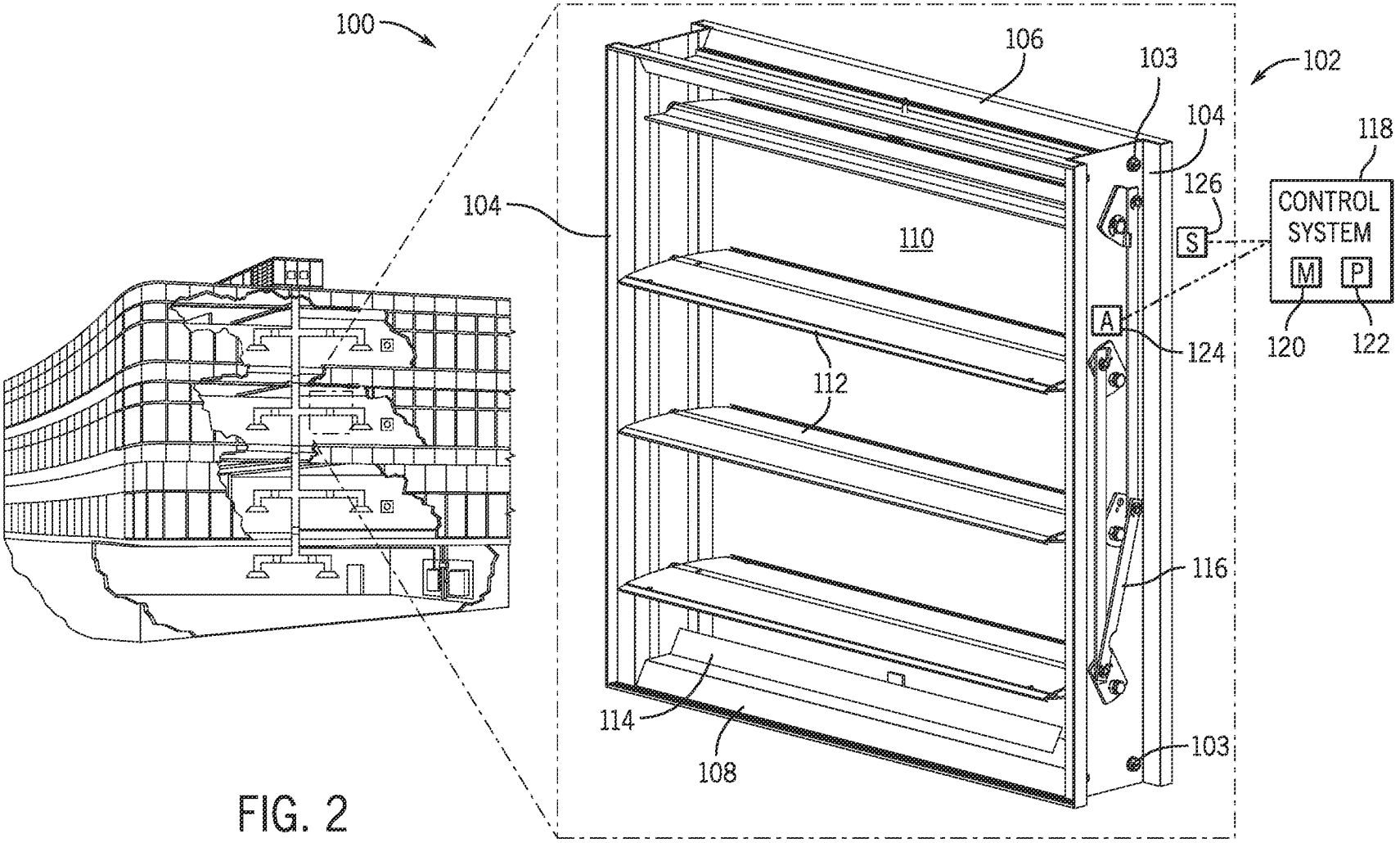
FIG. 2 is a perspective view of an embodiment of a damper that may be incorporated in an HVAC system, in accordance with an aspect of the present disclosure.

With this in mind, FIG. 2 is a perspective view of an embodiment of a damper or damper assembly 100 that may be incorporated in an HVAC system. For example, the damper 100 may be positioned within the ductwork 14 to control air flow through a portion of the ductwork 14. The damper 100 may include a frame 102 defining a perimeter of an air flow path through the damper 100. In some embodiments, the frame 102 may include multiple frame members that are coupled to one another (e.g., via fasteners 103) or are integrally formed (e.g., bent) to define the perimeter. As an example, the frame 102 may include side or lateral frame members 104 defining a portion of the perimeter of the air flow path. Each of the side frame members 104 may be configured to couple to a top frame member 106 and to a base frame member 108, and each of the top frame member 106 and the base frame member 108 may define additional portions of the perimeter of the air flow path. The frame members 104, 106, 108 of the illustrated frame 102 are coupled to one another to form a rectangular geometry. Indeed, each of the side frame members 104 may be coupled to the top frame member 106 and the base frame member 108 at generally perpendicular angles. However, additional or alternative frames 102 may have any suitable geometry, such as a triangular shape, a trapezoidal shape, a diamond shape, a circular shape, and so forth, and may include any suitable number of frame members 104, 106, 108 defining the geometry of the frame 102. For instance, the frame 102 may be shaped based on a cross sectional geometry of the ductwork 14 such that the frame 102 may effectively regulate air flow within and/or through the ductwork 14. In any case, when coupled to one another, the frame members 104, 106, 108 form an opening 110 (e.g., air flow path) through which air may flow.

In some embodiments, each of the frame members 104, 106, 108 may be manufactured from a metallic material. By way of example, each of the frame members 104, 106, 108 may be manufactured via an extrusion process, a metal bending process, and/or any other suitable metal forming process. Additionally or alternatively, the frame members 104, 106, 108 may be manufactured from any other suitable material, such as a polymer, a composite, and the like. Indeed, a material selected for manufacturing the frame 102 may be based on an application of the damper 100, such as based on an expected parameter or characteristic of air flowing through the damper 100 and/or based on an environment in which the damper 100 is installed.

The damper 100 may also include damper blades 112 that are coupled to the frame 102, such as to the side frame members 104. That is, each of the damper blades 112 may span across the opening 110 to couple to the side frame members 104. Although the illustrated damper 100 includes four damper blades 112, the damper 100 may alternatively include any suitable number of damper blades 112, such as one damper blade 112, two damper blades 112, three damper blades 112, or more than four damper blades 112. Further, in additional or alternative embodiments, the damper blades 112 may be coupled to any suitable combination of the frame members 104, 106, 108, such as the top frame member 106 and the base frame member 108, to one of the side frame members 104 and one of the top frame members 106 and the base frame member 108, to three of the frame members 104, 106, 108, and so forth.

In certain embodiments, the damper blades 112 may be configured to transition between an open configuration and a closed configuration. By way of example, each damper blade 112 may be rotatably coupled to the side frame members 104 to enable the damper blade 112 to rotate relative to the frame 102 and transition between the open configuration and the closed configuration. In additional or alternative embodiments, the damper blades 112 may transition between the open configuration and the closed configuration in any manner, such as by linearly translating relative to the frame 102. In the open configuration, the damper blades 112 may expose the opening 110, thereby enabling flow of air through the damper 100 via the opening 110. In the closed configuration, the damper blades 112 may cover the opening 110. For example, the damper blades 112 may overlap with (e.g., abut) one another to block air flow between the damper blades 112 and through the opening 110. In some embodiments, one or more seals 114 may be coupled to one of the frame members 104, 106, 108 to block air flow between the damper blades 112 and the frame members 104, 106, 108. For instance, in the illustrated embodiment, the seal 114 is coupled to the base frame member 108. In the closed position, the damper blade 112 most adjacent to the base frame member 108 may abut against the seal 114 to block air flow between the seal 114 and the damper blade 112. In any case, in the closed configuration, the damper blades 112 may cover the opening 110, thereby blocking air flow through the damper 100 via the opening 110.

In some embodiments, a user (e.g., an operator, a technician, an occupant of the building 10, etc.) may manually transition the damper blades 112 between the open configuration and the closed configuration. By way of example, the frame 102 may include a linkage system 116, which may be coupled to one of the frame members 104, 106, 108 (e.g., one of the side frame members 104), and the user may actuate the linkage system 116 to rotate the damper blades 112. In additional or alternative embodiments, a control system 118 (e.g., an electronic controller) may be configured to transition the damper blades 112 between the open configuration and the closed configuration. The control system 118 may include a memory 120 and processing circuitry 122. The memory 120 may include a non-transitory computer-readable medium storing instructions that, when executed by the processing circuitry 122, may cause the processing circuitry 122 to move the damper blades 112. To this end, the processing circuitry 122 may be any suitable type of computer processor or microprocessor capable of executing computer-executable code, including but not limited to one or more field programmable gate arrays (FPGA), application-specific integrated circuits (ASIC), programmable logic devices (PLD), programmable logic arrays (PLA), and the like.

The control system 118 may be communicatively coupled to an actuator 124, and the control system 118 may transmit a signal to the actuator 124 to cause the actuator 124 to actuate the linkage system 116, thereby moving the damper blades 112. Indeed, the control system 118 may be communicatively coupled to a sensor 126 configured to determine an operating parameter, such as a temperature of an air flow, a humidity of an air flow, a temperature of a space serviced by the HVAC system, a humidity of the space, and so forth, and the control system 118 may communicate with the actuator 124 to adjust the damper blades 112 based on sensor data received from the sensor 126 that is indicative of the operating parameter. As an example, the control system 118 may compare a value of the operating parameter with a threshold value to determine whether the damper blades 112 are to be transitioned between the open configuration and the closed configuration or any damper blade 112 position therebetween. As another example, the control system 118 may receive a signal (e.g., indicative of a user input), and the control system 118 may transition the damper blades 112 based on the signal. In any case, the control system 118 may adjust the damper 100 to enable or to block air flow through the damper 100.

Figure 3:
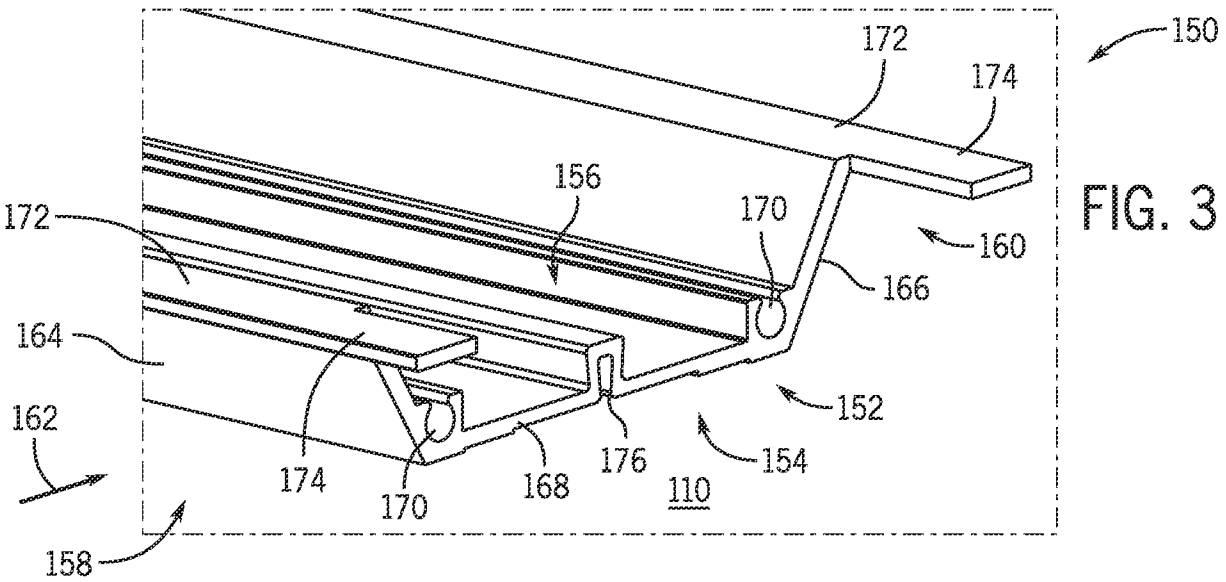
FIG. 3 is a perspective view of an embodiment of a frame member of a damper frame that may be incorporated in a damper, illustrating end portions of the frame member extending obliquely from a base portion of the frame member, in accordance with an aspect of the present disclosure.

FIG. 3 is a perspective view of an embodiment of a frame member 150 that may be incorporated in the frame 102. For instance, the illustrated embodiment of the frame member 150 may be used as the top frame member 106 and/or as the base frame member 108. The frame member 150 includes a base portion 152, which may have a first interior surface 154 (e.g., an exposed surface) that faces the opening 110 in an installed configuration of the frame member 150 with the damper 100, and an exterior surface 156 (e.g., a shielded surface) that faces away or outwardly from the opening 110 in the installed configuration of the frame member 150 with the damper 100. Further, the frame member 150 may include an upstream end portion 158 and a downstream end portion 160, each of which may extend linearly from the base portion 152 at an oblique angle. For example, each of the upstream end portion 158 and the downstream end portion 160 may be oriented relative to the base portion 152 at a respective, obtuse angle.

The illustrated arrangement of the base portion 152, the upstream end portion 158, and the downstream end portion 160 may facilitate and improve air flow through the damper 100. For instance, in the installed configuration of the damper 100, an air flow may be directed in a first direction 162 along the air flow path defined by the frame 102, such as the opening 110. That is, air may flow from the upstream end portion 158 and across the first interior surface 154 of the base portion 152 toward the downstream end portion 160. The oblique angle between the upstream end portion 158 and the base portion 152 may enable a second interior surface 164 (e.g., an exposed surface) of the upstream end portion 158 to guide the air flow toward the opening 110 and to enable a smooth transition of the air flow into the damper 100. In this manner, the upstream end portion 158 may reduce disturbance of the air flow. Similarly, the oblique angle between the downstream end portion 158 and the base portion 152 may enable a third interior surface 166 (e.g., an exposed surface) of the downstream end portion 160 to guide the air flow out of the opening 110 and reduce disturbance of the air flow to enable a smooth transition of the air flow out of the damper 100. As a result, the second interior surface 164 and the third interior surface 166 may mitigate certain air flow characteristics, such as flow vortices, flow separation, or other flow discontinuities, that may cause turbulent flow of air and/or increase the pressure drop (e.g., increase a reduction in velocity) of the air flow directed through the damper 100. In this manner, the orientation of the upstream end portion 158 and the downstream end portion 160 relative to the base portion 152 enables improved air flow through the damper 100 by maintaining a velocity of the air directed through the opening 110. In this way, the damper 100 may improve efficient air flow through the damper 100.

In the installed configuration of the damper 100, a lateral surface 168 (e.g., a surface extending perpendicularly between the first interior surface 154 and the exterior surface 156) of the frame member 150, may be configured to abut a surface (e.g., a corresponding interior or exposed surface) of another frame member. For example, the lateral surface 168 may abut a surface of an adjacent frame member of the frame 102 to form a substantially perpendicular angle (e.g., within 5 degrees) between the first interior surface 154 of the frame member 150 and an interior surface of the other, adjacent frame member (e.g., one of the side frame members 104). The abutment between the lateral surface 168 and the first interior surface 154 may form a portion of the perimeter of the opening 110. In the illustrated embodiment, the frame member 150 includes receptacles 170 formed in or through the lateral surface 168 and extending along the exterior surface 156 of the base portion 152 (e.g., along a length of the frame member 150). In the installed configuration, the receptacles 170 may align with corresponding openings or apertures of another frame member, and each receptacle 170 may receive a fastener (e.g., the fastener 103) extending through the opening and the receptacle 170 along the length of the frame member 150 to couple the frame member 150 with the other frame member. As such, the frame member 150 may be removably coupled to adjacent frame members by inserting and removing the fasteners 103. In this manner, assembly, installation, and/or modification of the frame 102 and the damper 100 is facilitated.

In some embodiments, each of the upstream end portion 158 and the downstream end portion 160 may also include a flange or lip 172 extending from a respective distal end of the upstream end portion 158 or the downstream end portion 160 and away from the base portion 152 (e.g., against or with the first direction 162 of the air flow). The flanges 172 may further facilitate coupling between the frame member 150 and another frame member of the frame 102. For example, each flange 172 may include a protrusion 174 that extends laterally or away from the lateral surface 168 (e.g., transverse to the first direction 162). The protrusion 174 may be configured to engage opposing features of an adjacent frame member of the frame 102. Indeed, such engagement between the protrusion 174 and the opposing features may further restrict movement of the frame member 150 relative to the adjacent frame member, thereby securing the position of the frame member 150 as a component of the frame 102.

In certain embodiments, the base portion 152 may include a notch 176 (e.g., a recess or a cavity) formed into and along the first interior surface 154 and extending along a length of the frame member 150. The notch 176 may receive and support a seal (e.g., the seal 114) in the installed configuration of the damper 100. For instance, the notch 176 may utilize a mechanical interference fit (e.g., a press fit, a slip fit) to secure the seal within the notch 176. As such, the notch 176 may facilitate blockage of air through the frame 102 in the closed configuration of the damper 100.

Figure 4:
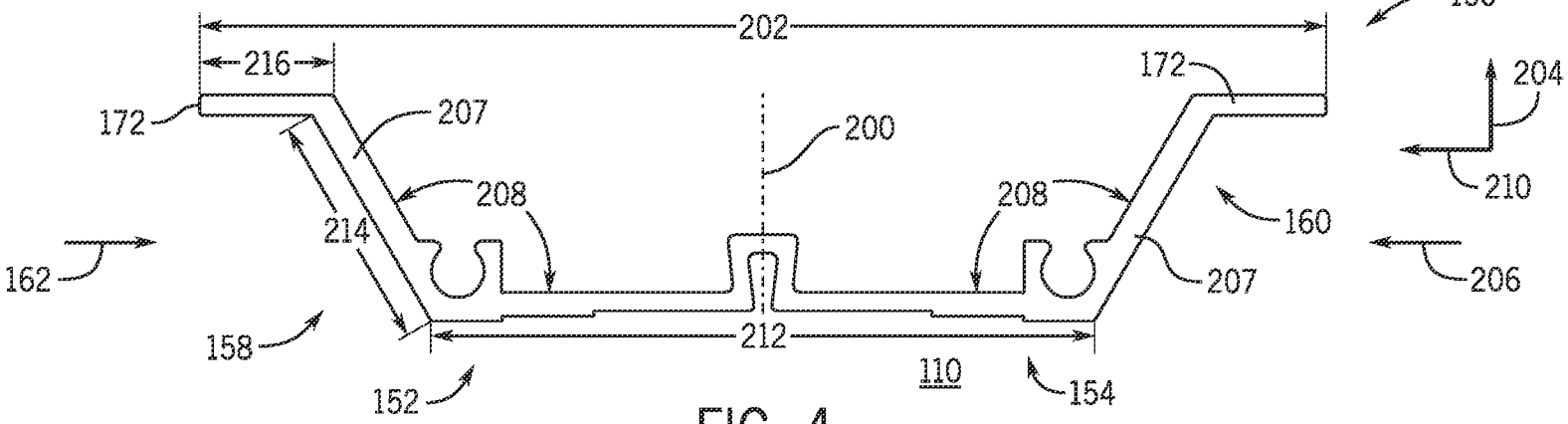
FIG. 4 is an axial view of the frame member of FIG. 3, in accordance with an aspect of the present disclosure.

FIG. 4 is an axial view of the frame member 150 of FIG. 3. The illustrated frame member 150 is symmetrical about a central axis 200 (e.g., a vertical axis) centered along a width 202 of the frame member 150 and extending along a vertical axis 204. However, in additional or alternative embodiments, the frame member 150 may be asymmetrical about the central axis 200. As described herein, each of the upstream end portion 158 and the downstream end portion 160 may have a linear segment or portion 207 oriented at an obtuse angle relative to the base portion 152. By way of example, an angle 208 formed between the linear segment 207 of the upstream end portion 158 and the base portion 152 and/or between the linear segment 207 of the downstream end portion 160 and the base portion 152 may be between approximately 105 degrees and 165 degrees or may be any suitable obtuse angle. Further, in the installed configuration of the damper 100, the base portion 152 and/or the flanges 172 of the illustrated frame member 150 may extend along a lateral axis 210. In additional or alternative embodiments, the flanges 172 may extend transversely relative to the lateral axis 210, such as at an obtuse angle or at an acute angle relative to the lateral axis 210 and/or the base portion 152.

The base portion 152 of the frame member 150 has a first dimension 212 (e.g., a width), each of the linear segments 207 has second dimension 214, and each of the flanges 172 has a third dimension 216 (e.g. width). In the illustrated embodiment, the first dimension 212 is greater than the second dimension 214, and the second dimension 214 is greater than the third dimension 216. For example, the first dimension 212 may be between approximately 5 centimeters (2 inches) and 10 centimeters (4 inches), the second dimension 214 may be between approximately 2 centimeters (0.8 inches) and 5 centimeters (2 inches), and the third dimension 216 may be between approximately 1 centimeter (0.4 inches) and 1.8 centimeters (0.7 inches). In additional or alternative embodiments, the first dimension 212, the second dimension 214, and the third dimension 216 may have any suitable magnitude relative to one another.

Figure 5:
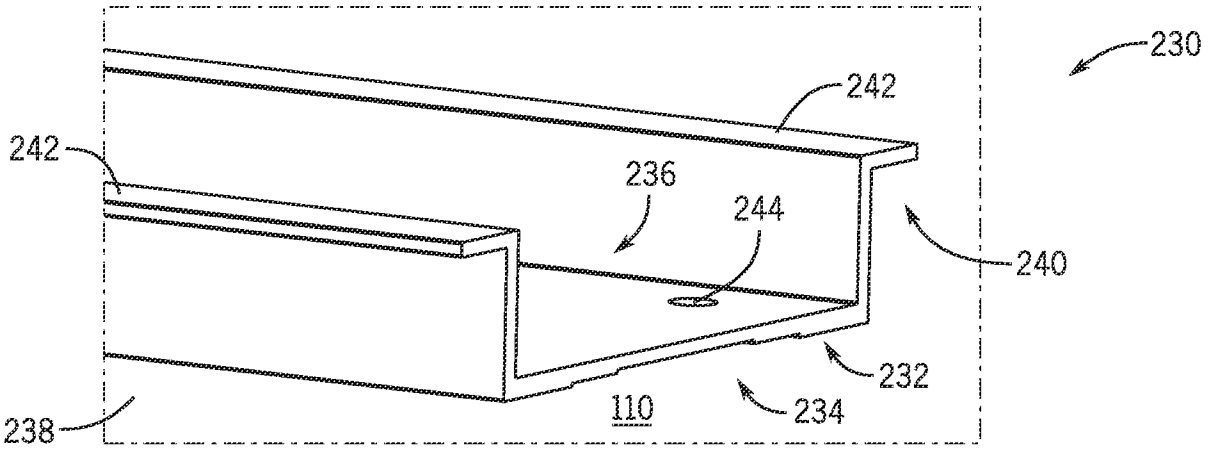
FIG. 5 is a perspective view of an embodiment of a frame member of a damper frame that may be incorporated in a damper, illustrating end portions of the frame member extending perpendicularly from a base portion of the frame member, in accordance with an aspect of the present disclosure.

FIG. 5 is a perspective view of an embodiment of a frame member 230 that may be incorporated in the frame 102. As an example, the illustrated embodiment of the frame member 230 may be used as the side frame members 104 and may be configured to couple to the frame member 150 described above with reference to FIGS. 3 and 4. The frame member 230 includes a base portion 232, which may have an interior surface 234 (e.g., a surface exposed to the opening 110) and an exterior surface 236 (e.g., a surface shielded from the opening 110). In the installed configuration of the damper 100, the interior surface 234 of the base portion 232 may be configured to engage with the lateral surface 168 of the base portion 152 of the frame member 150. The frame member 230 may also include an upstream end portion 238 and a downstream end portion 240 that may each extend from the base portion 232. Each of the upstream end portion 238 and the downstream end portion 240 may include a flange or lip 242 extending away from a respective distal end of the upstream end portion 238 or the downstream end portion 240 and away from the base portion 232. The orientation of each flange 242 may facilitate engagement between the frame member 230 and the frame member 150. By way of example, the upstream end portion 238, the downstream end portion 240, and the flanges 242 may be configured to engage with one or both of the protrusions 174 of the frame member 150 in the installed configuration. This engagement between the frame member 230 and the frame member 150 may restrict relevant movement between the frame member 230 and the frame member 150 so as to secure the frame member 150 and the frame member 230 to one another. The frame member 230 may also have an opening or an aperture 244 formed through the base portion 232. In the installed configuration, the opening 244 may align with one of the receptacles 170 of the frame member 150, and a fastener may extend through the opening 244 and into the receptacle 170 to secure the frame member 150 and the frame member 230 to one another.

Figure 6:
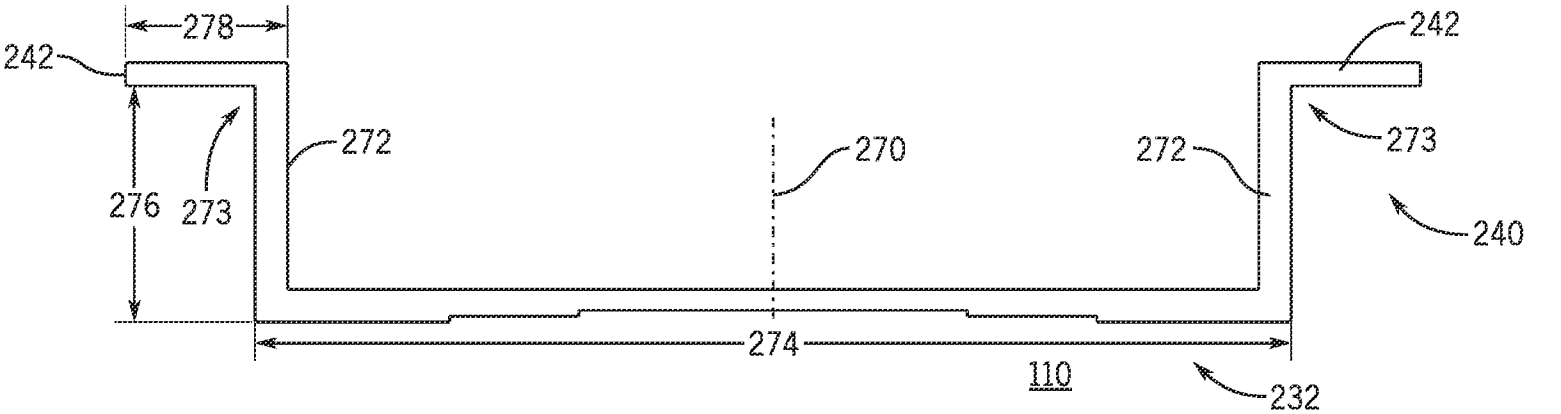
FIG. 6 is an axial view of the frame member of FIG. 5, in accordance with an aspect of the present disclosure.

FIG. 6 is an axial view of the frame member 230. The frame member 230 may be symmetrical about a central axis 270 (e.g., a vertical axis). For example, each of the upstream end portion 238 and the downstream end portion 240 may have a linear segment or portion 272 that extends perpendicularly or substantially perpendicularly (e.g., within 5 degrees) from the base portion 232 and in a direction of the central axis 270. Further, each of the flanges 242 may extend from one of the linear segments 272 parallel to or substantially parallel to (e.g., within 5 degrees) the base portion 232. In this manner, the arrangement of the flanges 242 may form a corner or a bend 273 that may receive and/or accommodate one of the protrusions 174 of the frame member 150 in the installed configuration. That is, the protrusion 174 may be configured to engage the frame member 230 between the linear segment 272 and the flange 242 of the upstream end portion 238 or between the linear segment 272 and the flange 242 of the downstream end portion 240 in the installed configuration.

The base portion 232 of the frame member 230 has a first dimension 274 (e.g., a width), each of the linear segments 272 has a second dimension 276 (e.g., a width), and each of the flanges 242 has a third dimension 278 (e.g., a width). In the illustrated embodiment, the first dimension 274 is greater than the second dimension 276, and the second dimension 276 is greater than the third dimension 278. For instance, the first dimension 274 may be between approximately 7.5 centimeters (3 inches) and 12.5 centimeters (5 inches), the second dimension 276 may be between approximately 1.3 centimeters (0.5 inches) and 4 centimeters (1.6 inches), and the third dimension 278 may be between approximately 0.5 centimeters (0.2 inches) and 2 centimeters (0.8 inches). In additional or alternative embodiments, the first dimension 274, the second dimension 276, and the third dimension 278 may have any suitable magnitudes relative to one another (e.g., the third dimension 278 may be greater than the second dimension 276).

Figure 7:
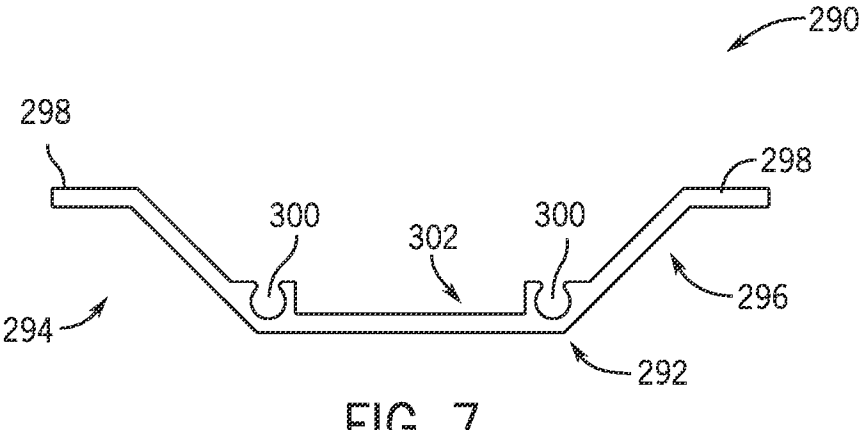
FIG. 7 is an axial view of an embodiment of a frame member of a damper frame, illustrating end portions of the frame member extending obliquely from a base portion of the frame member, in accordance with an aspect of the present disclosure.

FIG. 7 is an axial view of an embodiment of a frame member 290, which may be an embodiment of the top frame member 106 or the base frame member 108. The illustrated frame member 290 may have a similar geometry as that of the frame member 150 illustrated in FIG. 4, including a base portion 292, an upstream end portion 294, a downstream end portion 296, and flanges 298. The upstream end portion 294 and the downstream end portion 296 each extend obliquely and linearly from the base portion 292. Further, each of the upstream end portion 294 and the downstream end portion 296 includes flanges 298 that extend from respective distal ends of the upstream end portion 294 and the downstream end portion 296. The frame member 290 may further include receptacles 300 formed in or on the base portion 292 (e.g., along an exterior surface 302 of the base portion 292). In the installed configuration, each of the receptacles 300 may receive a respective fastener to couple the frame member 290 to another adjacent frame member, such as to the frame member 230 illustrated in FIGS. 5 and 6. In the illustrated embodiment, the frame member 290 does not include a notch formed in the base portion 292. Therefore, the frame member 290 may be incorporated in the frame 102 without accommodating or supporting the seal 114.

Figure 8:
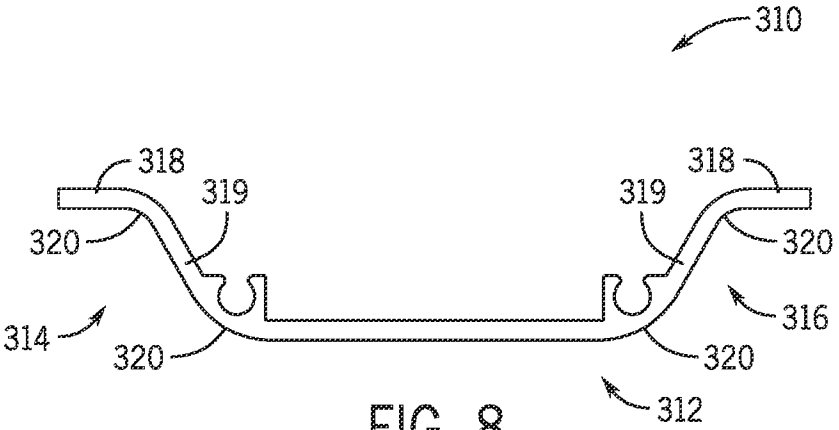
FIG. 8 is an axial view of an embodiment of a frame member of a damper frame, illustrating fillets extending between end portions of the frame member and a base portion of the frame member, in accordance with an aspect of the present disclosure.

FIG. 8 is an axial view of an embodiment of a frame member 310. The frame member 310 may have a similar geometry as that of the frame member 290 described above with reference to FIG. 7. For example, the frame member 310 includes a base portion 312, an upstream end portion 314, and a downstream end portion 316. The upstream end portion 314 and the downstream end portion 316 extend obliquely from the base portion 312 and include the flanges 318 that extend from respective linear segments 319 of the upstream end portion 314 and the downstream end portion 316. Additionally, the illustrated embodiment of the frame member 310 includes edge fillets 320. The edge fillets 320 are formed at transitions between the base portion 312 and the upstream end portion 314, between the base portion 312 and the downstream end portion 316, between the flange 318 and the linear segment 319 of the upstream end portion 314, and between the flange 318 and the linear segment 319 of between the downstream end portion 316 and the corresponding flange 318. The edge fillets 320 may further enable a smooth transition of air flow into and/or out of the damper 100. Indeed, incorporating the edge fillets 320 may reduce sharp edges or corners formed in the frame member 310 and facilitate a reduction in the formation of flow discontinuities in the air flow, thereby enabling more efficient flow of air through the damper 100.

Figure 9:
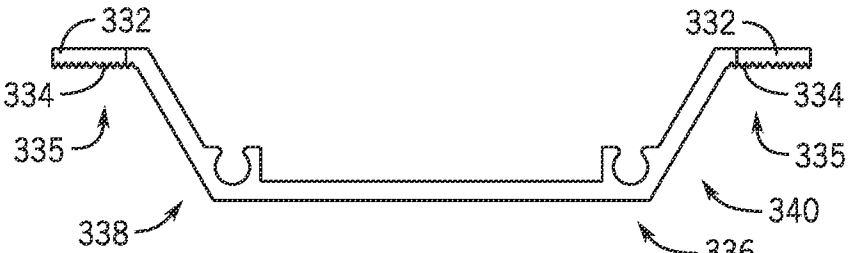
FIG. 9 is an axial view of an embodiment of a frame member of a damper frame, illustrating end portions of the frame member extending obliquely from a base portion of the frame member, in accordance with an aspect of the present disclosure.

FIG. 9 is an axial view of an embodiment of a frame member 330, which may have a similar geometry as that of the frame member 290 described above with reference to FIG. 7. However, the illustrated frame member 330 further includes flanges 332 having surface enhancements 334. The surface enhancements 334 may be applied to inner surfaces 335 (e.g., exposed surfaces) of the flanges 332, as shown, and may include teeth, knurling, grips, dimples, or other suitable patterns or formations. The surface enhancements 334 may facilitate directing of air flow through the damper 100. As an example, the surface enhancements may increase an efficiency of air flow directed through the damper 100, such as by inducing the air to flow through the space 110 or blocking air from flowing in an undesirable manner (e.g., away from the space 110). Additionally or alternatively, the surface enhancements 334 may improve coupling and/or engagement between the frame member 330 and a corresponding, adjacent frame member (e.g., the frame member 230) to which the frame member 330 is coupled. As another example, in the installed configuration, the surface enhancements 334 of the flanges 332 of the frame member 330 may engage with a corresponding flange 242 of the frame member 230 and increase a coefficient of friction between the flanges 332 and the flanges 242. In this way, the surface enhancements 334 may block relative movement between the flanges 332 and the flanges 242, further blocking relative movement between the frame member 230 and the frame member 330. Therefore, the surface enhancements 334 may further secure the frame member 230 and the frame member 330 with one another and improve structural integrity of the frame 102. Although the illustrated frame member 330 includes surface enhancements 334 applied on the flanges 332, in additional or alternative embodiments, the surface enhancements 334 may be applied on different portions of the frame member 330, such as on a base portion 336, on an upstream end portion 338, on a downstream end portion 340, or any combination thereof, of the frame member 330.

Figure 10:
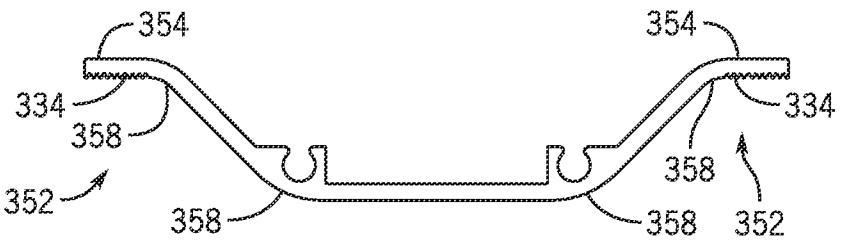
FIG. 10 is an axial view of an embodiment of a frame member of a damper frame, illustrating fillets extending between end portions of the frame member and a base portion of the frame member, in accordance with an aspect of the present disclosure.

FIG. 10 is an axial view of an embodiment of a frame member 350, which may have a similar geometry as that of the frame member 330 described above with reference to FIG. 9. The frame member 350 also includes surface enhancements 334 formed on inner surfaces 352 of flanges 354 of the frame member 350. The frame member 350 may further include edge fillets 358 that enable a smooth transition of air flow into and/or out of the damper 100, as similarly described above with reference to FIG. 8. As such, the frame member 350 may be better secured to an adjacent frame member (e.g., the frame member 230), while also providing more efficient air flow through the damper 100.

Figure 11:
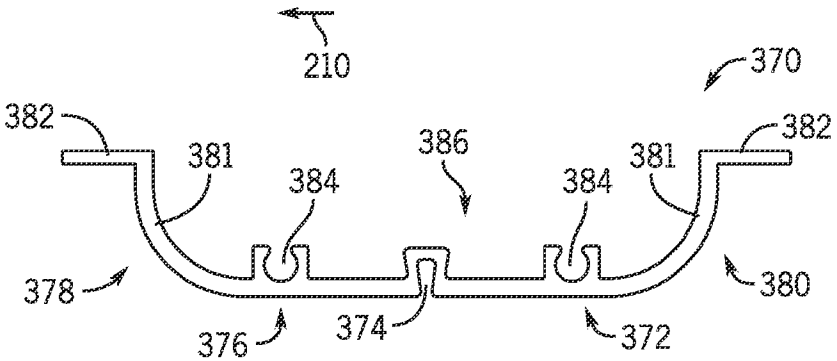
FIG. 11 is an axial view of an embodiment of a frame member of a damper frame, illustrating end portions of the frame member extending from a base portion of the frame member via arcuate segments, in accordance with an aspect of the present disclosure.

FIG. 11 is an axial view of an embodiment of a frame member 370, which may be used as one of the side frame members 104 of the frame 102. The frame member 370 has a base portion 372, which includes a notch 374 formed at an inner surface 376 (e.g., surface exposed to the opening 110) of the base portion 372. The frame member 370 may also include an upstream end portion 378 and a downstream end portion 380. Each of the upstream end portion 378 and the downstream end portion 380 may include an arcuate segment or portion 381 extending (e.g., obliquely) from the base portion 372. As an example, the radius of the arcuate segment 381 may be greater than approximately 1 centimeter (0.4 inches). As another example, the arcuate segment 381 of the upstream end portion 378 and/or of the downstream end portion 380 may have an arc length that is greater than 1.6 centimeters (0.6 inches). The arcuate segment 381 may enable a smooth transition of air flow through the damper 100. For example, incorporation of the arcuate segment 381 may avoid inclusion of sharp edges or corners between the base portion 372 and the upstream end portion 378 and/or between the base portion 372 and the downstream end portion 380. Thus, air flowing through the damper 100 may flow more smoothly along the arcuate segments 381. Although the illustrated arcuate segments 381 of the upstream end portion 378 and/or the downstream end portion 380 have a geometric central angle of approximately 90 degrees, in additional or alternative embodiments, the arcuate segments 381 may have any suitable central angle, such as an angle between approximately 30 degrees and 50 degrees, an angle between approximately 50 degrees and 70 degrees, an angle between approximately 70 degrees and 90 degrees, or an angle between approximately 90 degrees and 100 degrees.

Each of the upstream end portion 378 and the downstream end portion 380 may further include a flange 382 that extends from the arcuate segment 381, such as along the lateral axis 210 in the installed configuration of the damper 100. In the illustrated embodiment, each flange 382 forms a corner relative to the respective arcuate segment 381 of the upstream end portion 378 or the downstream end portion 380. In additional or alternative embodiments, edge fillets (e.g., the edge fillets 320 illustrated in FIG. 8) may be implemented to provide a more smooth transition between the arcuate segments 381 and the flanges 382. The frame member 370 may also include receptacles 384 formed on the base portion 372 (e.g., along an exterior surface 386 of the base portion 372). In the installed configuration, each of the receptacles 384 may receive a respective fastener to couple the frame member 370 to another adjacent frame member, such as the frame member 230.

Figure 12:
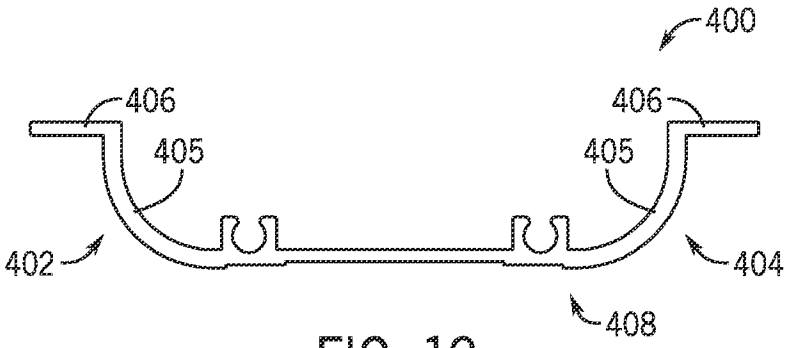
FIG. 12 is an axial view of an embodiment of a frame member of a damper frame, illustrating end portions of the frame member extending from a base portion of the frame member via arcuate segments, in accordance with an aspect of the present disclosure.

FIG. 12 is an axial view of an embodiment of a frame member 400, which may be similar to the frame member 370 described above with reference to FIG. 11. The frame member 400 includes an upstream end portion 402 and a downstream end portion 404 that each include an arcuate segment 405, as well as respective flanges 406 extending from the upstream end portion 402 and from the downstream end portion 404. However, the frame member 400 does not include a notch formed in a base portion 408. As such, the frame member 400 may be incorporated in the frame 102 without accommodating or supporting a seal.

Figure 13:
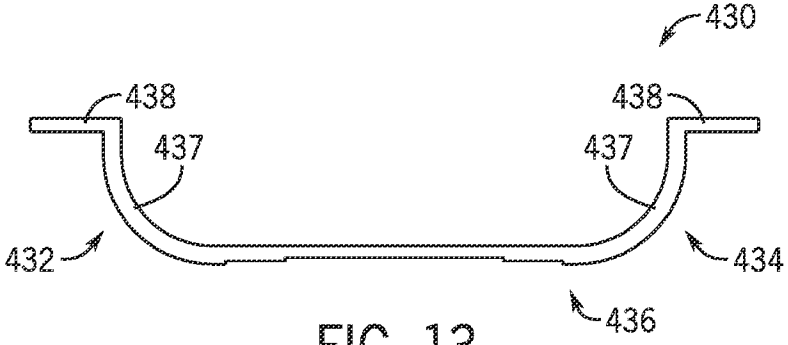
FIG. 13 is an axial view of an embodiment of a frame member of a damper frame, illustrating end portions of the frame member extending from a base portion of the frame member via arcuate segments, in accordance with an aspect of the present disclosure.

FIG. 13 is axial view of an embodiment of a frame member 430, which may be used as one of the side frame members 104. The frame member 430 may include a base portion 432, an upstream end portion 434 and a downstream end portion 436 extending from the base portion 432, and respective flanges 438 extending from the upstream end portion 434 and off the downstream end portion 436. Each of the upstream end portion 434 and the downstream end portion 436 may include an arcuate segment 437. However, the frame member 430 in the illustrated embodiment does not include a notch or receptacles formed along the base portion 432. Rather, the base portion 432 may include openings (not shown) that may align with receptacles of another adjacent frame member in the installed configuration of the frame 102. A fastener may extend through each aligned corresponding opening and receptacle to couple the frame member 430 to another adjacent frame member. Further, in the installed configuration, a protrusion (e.g., the protrusion 174) of another frame member may be configured to engage one of the arcuate segments 437 and a corresponding flange 438. In this manner, the arcuate segments 437 of the frame member 430 may restrict relative movement between the frame member 430 and another adjacent frame member coupled to the frame member 430.

Figure 14:
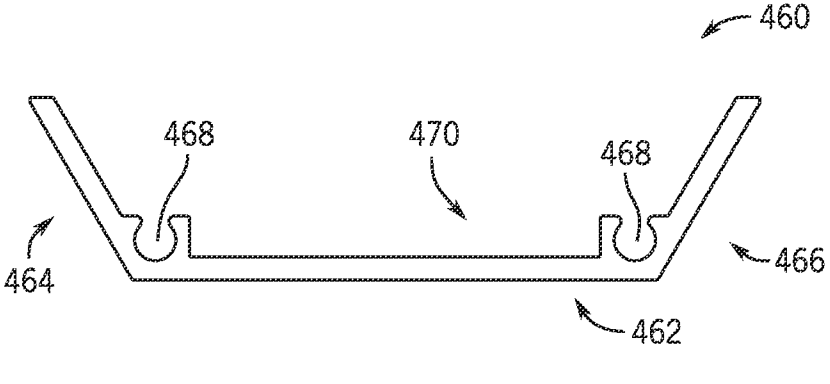
FIG. 14 is an axial view of an embodiment of a frame member of a damper frame, illustrating end portions of the frame member without flanges, in accordance with an aspect of the present disclosure.

FIG. 14 is an axial view of an embodiment of a frame member 460. The frame member 460 may have a geometry similar to that of the frame member 290 described above. For example, the frame member 460 may include a base portion 462 and an upstream end portion 464 and a downstream end portion 466 extending obliquely from the base portion 462. Further, the frame member 460 may include receptacles 468, which may be formed along an exterior surface 470 of the base portion 462. However, the frame member 460 in the illustrated embodiment does not include flanges extending from the upstream end portion 464 and the downstream end portion 466. As such, the frame member 460 also may not include a protrusion that further engages the frame member 460 to an adjacent frame member. Nevertheless, the geometry of the frame member 460 may enable air to be directed through the damper 100 more efficiently. For instance, in some circumstances, the absence of flanges may improve efficient air flow through the damper 100. Furthermore, the absence of flanges reduces an amount of material used to manufacture the frame member 430. As such, costs associated with manufacturing the frame member 430 and/or a weight of the frame member 430 may be reduced. The illustrated frame member 430 does not include a notch formed on the base portion 462. However, in additional or alternative embodiments, the frame member 430 may include a notch to accommodate and support a seal coupled to the frame member 430.

Figure 15:
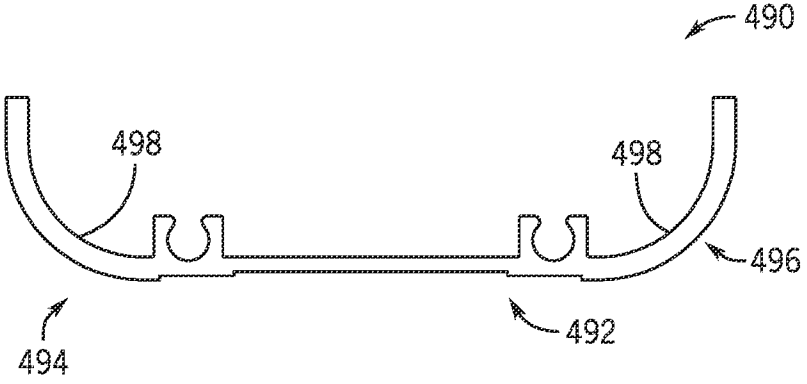
FIG. 15 is an axial view of an embodiment of a frame member of a damper frame, illustrating end portions of the frame member without flanges, in accordance with an aspect of the present disclosure.

FIG. 15 is an axial view of an embodiment of a frame member 490, which may have a similar geometry as that of the frame member 400. That is, the frame member 490 may include a base portion 492 and an upstream end portion 494 and a downstream end portion 496 extending obliquely from the base portion 492. Each of the upstream end portion 494 and the downstream end portion 496 may include an arcuate segment 498. As similarly discussed above, the arcuate segment 498 may enable more efficient flow of air through the damper 100. In the illustrated embodiment, the frame member 490 does not include a notch formed on the base portion 492 or flanges extending from the upstream end portion 494 or the downstream end portion 496, which may reduce a cost and/or a weight of the frame member 490.

FIG. 16 is an axial view of an embodiment of a frame member 520 having asymmetrical end portions. In the illustrated embodiment, a first end portion 522, such as an upstream end portion, may have an arcuate segment 524 extending obliquely from a base portion 526 of the frame member 520. Further, a second end portion 528, such as a downstream end portion, may extend from the base portion 526 via an edge fillet 530. The arcuate segment 524 may have a first radius, the edge fillet 530 may have a second radius, and the first radius may be greater than the second radius. In this manner, the end portions 522, 528 may be oriented relative to the base portion 526 in different manners. The asymmetrical orientation of the end portions 522, 528 may further improve efficient flow of air through the damper 100. For instance, the end portions 522, 528 may specifically be manufactured to accommodate air flowing through a particular portion of the damper 100 in a specific direction. By way of example, the end portion 522 (e.g., an upstream end portion) may be manufactured specifically based on an expected characteristic of the air when the air flows from the end portion 522 toward the base portion 526. Additionally, the end portion 528 (e.g., a downstream end portion) may be manufactured specifically based on an expected characteristic of the air when the air flows from the base portion 526 toward the end portion 528. In this manner, the frame member 520 may direct air through the damper 100 more efficiently and effectively (e.g., by limiting the velocity or pressure drop of the air).

FIG. 17 is an axial view of an embodiment of a frame member 560 having asymmetrical end portions. The frame member 560 may have a first end portion 562, such as an upstream end portion, that may extend obliquely and linearly from a base portion 564 at a first angle 566. The frame member 560 may also have a second end portion 568, such as a downstream end portion, that may extend obliquely and linearly from the base portion 564 at a second angle 570. In the illustrated embodiment, the first angle 566 is greater than the second angle 570. For instance, the orientation between the first end portion 562 and the base portion 564 may more efficiently or effectively guide air entering the damper 100, and the orientation between the second end portion 568 and the base portion 564 may more efficiently or effectively guide air exiting the damper 100.

In additional or alternative embodiments, the frame member 560 may have asymmetrical end portions oriented in manners that are different than illustrated herein. In an example, the first end portion 562 may have an arcuate segment extending obliquely from the base portion 564, and the second end portion 568 may extend obliquely and linearly from the base portion 564. In another example, one of the first end portion 562 or the second end portion 568 may have a flange, and the other of the first end portion 562 or the second end portion 568 may not have a flange. In a further example, one of the first end portion 562 or the second end portion 568 may have edge fillets, and the other of the first end portion 562 or the second end portion 568 may not have edge fillets. Indeed, the first end portion 562 and/or the second end portion 568 may be specifically manufactured to accommodate the air flowing through the damper 100 in a particular location and/or in a particular manner.

The present disclosure may provide one or more technical effects useful in the operation of an HVAC system. For example, the HVAC system may direct air through ductwork, and a damper may be positioned within the ductwork to enable or block air flow through a portion of the ductwork. The ductwork may include a frame, which may define an opening through which air may flow. The frame may have a geometry that enables air to be directed more efficiently through the opening. For instance, the frame may have frame members that each include a base portion and end portions extending obliquely from the base portion. In some embodiments, an end portion may extend linearly from the base portion, such as at an obtuse angle. In additional or alternative embodiments, an end portion may have an arcuate segment extending from the base portion. In any case, the orientation between the end portion and the base portion may guide the air to flow through the opening more effectively or efficiency by mitigating generation of flow discontinuities or other undesirable flow characteristics, thereby maintaining a desirable air flow through the damper. As such, the damper may limit a pressure drop and/or a velocity drop of the air flow. As a result, the HVAC system may operate more efficiently to direct air through the damper. By way of example, a blower or fan may operate at a lower power level and direct the air flow through the ductwork at a desirable flow rate or speed. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A damper for a heating, ventilation, and air conditioning (HVAC) system, comprising:

a damper blade;

a frame coupled to the damper blade and defining a perimeter of an air flow path through the damper, wherein the damper blade is adjustable relative to the frame, and the damper blade is disposed within the air flow path and internal to the frame; and a frame member of the frame, wherein the frame member defines a portion of the perimeter of the air flow path and comprises a base portion extending in a direction of an air flow along the air flow path, an upstream end portion, and a downstream end portion, wherein the base portion includes an interior surface that faces the air flow path and an exterior surface that faces opposite the interior surface, wherein each of the upstream end portion and the downstream end portion extends at an oblique angle from the base portion and in a direction away from the damper blade such that the base portion is closer to the damper blade than either the upstream end portion or the downstream end portion, wherein each of the oblique angles is between the exterior surface of the base portion and the upstream end portion and the downstream end portion, respectively, and wherein the base portion comprises a notch formed along the interior surface of the base portion facing the air flow path, and the notch is configured to receive and support a seal in an installed configuration of the damper.

2. The damper of claim 1, wherein the upstream end portion or the downstream end portion comprises an arcuate segment extending from the base portion.

3. The damper of claim 1, comprising an additional frame member of the frame, wherein the additional frame member defines an additional portion of the perimeter, the additional frame member comprises an additional upstream end portion, an additional downstream end portion, and an additional base portion disposed between the additional upstream end portion and the additional downstream end portion.

4. The damper of claim 3, wherein the additional frame member is coupled to the frame member, and each of the additional upstream end portion and the additional downstream end portion extends perpendicularly from the additional base portion.

5. The damper of claim 3, wherein the additional frame member comprises a first flange extending from a first distal end of the additional upstream end portion, the frame member comprises a second flange extending from a second distal end of the upstream end portion and a protrusion extending from the second flange, and the protrusion is configured to engage with the additional frame member between the additional upstream end portion and the first flange in the installed configuration of the damper.

6. The damper of claim 5, wherein the frame member comprises a receptacle formed along the exterior surface of the base portion, the additional frame member comprises an opening formed through the additional base portion, and the frame member and the additional frame member are configured to be secured to one another via a fastener extending through the opening and into the receptacle along a length of the frame member.

7. The damper of claim 5, wherein the protrusion comprises surface enhancements configured to engage the first flange of the additional frame member in the installed configuration of the damper.

8. The damper of claim 1, wherein the frame member is disposed at a top of the frame or at a base of the frame.

9. The damper of claim 1, wherein the oblique angle is between 105 degrees and 165 degrees.

10. A damper frame of a damper for a heating, ventilation, and air conditioning (HVAC) system, comprising:

a frame member defining a portion of a perimeter of an air flow path through the damper and configured to couple to and support a damper blade disposed internal to the damper frame and within the air flow path, wherein the frame member is a single piece comprising:

a base portion including an interior surface that faces the air flow path and an exterior surface that faces opposite the interior surface;

an upstream end portion extending in a direction away from the damper blade, the upstream end portion extending obliquely from the base portion at a first angle, the first angle being between the exterior surface of the base portion and the upstream end portion;

a downstream end portion extending in the direction away from the damper blade, the downstream end portion extending obliquely from the base portion at a second angle, the second angle being between the exterior surface of the base portion and the downstream end portion;

a first flange extending from the downstream end portion in a first direction of an air flow along the air flow path; and a second flange extending from the upstream end portion in a second direction, opposite the first direction, wherein the base portion is closer to the damper blade than either the upstream end portion or the downstream end portion.

11. The damper frame of claim 10, wherein the upstream end portion, the downstream end portion, or both, is a linear segment extending from the base portion.

12. The damper frame of claim 10, wherein the first angle and the second angle are between 105 degrees and 165 degrees.

13. The damper frame of claim 10, comprising an edge fillet between the upstream end portion and the base portion, between the downstream end portion and the base portion, or both.

14. The damper frame of claim 10, wherein the first angle is different from the second angle.

15. The damper frame of claim 10, wherein the upstream end portion comprises a first arcuate segment extending from the base portion, the downstream end portion comprises a second arcuate segment extending from the base portion, the first arcuate segment comprises a first radius, the second arcuate segment comprises a second radius, and the first radius is different from the second radius.

16. A damper for a heating, ventilation, and air conditioning (HVAC) system, comprising:

a frame defining a perimeter of an air flow path through the damper, wherein the frame comprises:

a first frame member, wherein the first frame member is a first single piece, defining a portion of the perimeter of the air flow path and comprising a first base portion extending in a direction of an air flow along the air flow path, a first upstream end portion, and a first downstream end portion, wherein the first upstream end portion, the first downstream end portion, or both, extend at a first oblique angle from the first base portion extending in the direction of the air flow, wherein the first oblique angle is between an exterior surface of the first base portion and the first upstream end portion and the first downstream end portion, respectively; and a second frame member, wherein the second frame member is a second single piece coupled to the first frame member, defining an additional portion of the perimeter of the air flow path, wherein the second frame member comprises a second base portion extending in the direction of the air flow along the air flow path, a second upstream end portion, and a second downstream end portion, and each of the second upstream end portion and the second downstream end portion extends from the second base portion in the direction of the air flow; and a damper blade coupled to the second frame member, wherein the damper blade is disposed internal to the frame and within the air flow path, wherein the second upstream end portion, the second downstream end portion, or both, extends perpendicularly from the second base portion.

17. The damper of claim 16, wherein the first base portion of the first frame member comprises a notch formed along an interior surface of the first base portion facing the air flow path, and the notch is configured to receive and support a seal in an installed configuration of the damper.

18. The damper of claim 17, wherein the damper blade is configured to transition between an open configuration and a closed configuration, and the damper blade is configured to abut the seal in the closed configuration.

19. The damper of claim 16, wherein the second upstream end portion, the second downstream end portion, or both, comprises an arcuate segment extending from the second base portion.

* * * * *